US006950717B1

(12) United States Patent
Pierce et al.

(10) Patent No.: US 6,950,717 B1
(45) Date of Patent: Sep. 27, 2005

(54) SYSTEM AND METHOD FOR CONTROLLING WIDTH AND STITCH DENSITY OF A FABRIC WEB

(75) Inventors: Glenn Robert Pierce, Winston-Salem, NC (US); Jimmy Franklin Plyler, Salisbury, NC (US); Donald Frank Austin, Salisbury, NC (US); Michael Thomas Fox, Locust, NC (US); Larry Thomas Clodfeller, Salisbury, NC (US)

(73) Assignee: Sara Lee Corporation, Winston-Salem, NC (US)

( * ) Notice: Subject to any disclaimer, the term of this patent is extended or adjusted under 35 U.S.C. 154(b) by 0 days.

(21) Appl. No.: 10/804,943

(22) Filed: Mar. 19, 2004

(51) Int. Cl.[7] ..... G06F 7/66
(52) U.S. Cl. ..... 700/136; 26/74
(58) Field of Search ..... 112/470.03, 470.31, 112/318, 322, 305, 475.02; 700/130, 136, 700/141, 143

(56) References Cited

U.S. PATENT DOCUMENTS

| | | | | |
|---|---|---|---|---|
| 3,171,579 | A | 3/1965 | Robertson | 226/23 |
| 3,625,048 | A | 12/1971 | Roitel | 73/37.7 |
| 3,721,809 | A | 3/1973 | Strandberg, Jr. et al. | 235/92 PD |
| 3,774,271 | A | 11/1973 | Depuy et al. | 26/66 |
| 3,857,023 | A | 12/1974 | McCall | 235/151.1 |
| 4,103,177 | A | 7/1978 | Sanford et al. | 250/562 |
| 4,124,300 | A | 11/1978 | Mead et al. | 356/429 |
| 4,381,586 | A | 5/1983 | Abler | 26/2 E |
| 4,517,712 | A | 5/1985 | Diggle, Jr. et al. | 26/51.4 |
| 4,744,035 | A | 5/1988 | Hashim | 364/470 |
| 4,775,238 | A | 10/1988 | Weber | 356/431 |
| 4,874,241 | A | 10/1989 | Egea et al. | 356/238 |
| 4,890,924 | A | 1/1990 | Beckstein | 356/429 |
| 4,938,601 | A | 7/1990 | Weber | 356/429 |
| 4,953,400 | A | 9/1990 | Bossuyt | 73/159 |
| 4,984,896 | A | 1/1991 | Flamig | 356/429 |
| 5,125,034 | A | 6/1992 | Hudson et al. | 382/1 |
| 5,256,883 | A | 10/1993 | Weichmann et al. | 250/559 |
| 5,301,129 | A | 4/1994 | McKaughan et al. | 364/552 |
| 5,533,145 | A | 7/1996 | Shofner et al. | 382/141 |
| 5,684,598 | A | 11/1997 | Harke et al. | 356/430 |
| 5,694,979 | A | 12/1997 | Toda | 139/1 B |
| 5,742,398 | A | 4/1998 | Laucournet | 356/429 |
| 5,867,878 | A * | 2/1999 | Foster et al. | 26/74 |
| 5,949,550 | A | 9/1999 | Arndt et al. | 356/430 |
| 5,990,468 | A | 11/1999 | Cornuejols | 250/208.1 |
| 5,991,046 | A | 11/1999 | Shakespeare et al. | 356/429 |
| 6,038,750 | A | 3/2000 | Pabst | 26/76 |
| 6,111,651 | A | 8/2000 | Shakespeare | 356/429 |
| 6,226,088 | B1 | 5/2001 | Keane | 356/430 |
| 6,236,429 | B1 | 5/2001 | Ho | 348/88 |
| 6,259,526 | B1 * | 7/2001 | Pace et al. | 356/431 |

(Continued)

*Primary Examiner*—John J. Calvert
*Assistant Examiner*—Brian Kauffman
(74) *Attorney, Agent, or Firm*—Womble Carlyle Sandridge & Rice, PLLC

(57) ABSTRACT

A system for controlling the width and stitch density of a moving fabric web compacted by a fabric compaction system. The width control subsystem comprises a first camera which captures an image of a moving fabric web, and a first controller, wherein the first controller receives the captured image, calculates the width of the fabric web, and compares the calculated width to a first width set point. The stitch count control subsystem comprises a second camera that captures an image of a moving fabric web, and a second controller, wherein the second controller receives the captured image, calculates the stitch count of the fabric web, and compares the calculated stitch count to a first stitch count set point.

79 Claims, 5 Drawing Sheets

U.S. PATENT DOCUMENTS

| | | | | |
|---|---|---|---|---|
| 6,452,679 | B1 | 9/2002 | Workman, Jr. | 356/429 |
| 6,459,494 | B1 | 10/2002 | Kurokawa et al. | 356/637 |
| 6,462,820 | B1 | 10/2002 | Pace et al. | 356/430 |
| 6,531,707 | B1 | 3/2003 | Pavreau et al. | 250/559.46 |
| 6,690,987 | B2 * | 2/2004 | Baudry et al. | 700/135 |
| 2001/0030749 | A1 | 10/2001 | Ho et al. | 356/430 |
| 2001/0050772 | A1 | 12/2001 | Meinlschmidt et al. | 356/430 |
| 2002/0154307 | A1 | 10/2002 | Bjork | 356/430 |

* cited by examiner

SYSTEM AND METHOD FOR CONTROLLING WIDTH AND STITCH DENSITY OF A FABRIC WEB

FIELD OF THE INVENTION

The present invention relates generally to fabric finishing, and, more particularly to automatic fabric width and stitch density control systems for use in connection with fabric compactors.

BACKGROUND OF THE INVENTION

In the manufacture of apparel, particularly knitted fabrics, once greige goods have been knit, they are inspected and transferred to a finishing line where one or more types of finishing operations are undertaken. During finishing, the goods may be bleached or dyed in preparation for cutting. Some fabric constructions, such as knitted fabrics, are not dimensionally stable, that is, their stitch density or width, for example, may vary based on machinery, knit type, material type, and other factors. Thus, knitted fabrics are typically subjected to mechanical compacting to dimensionally stabilize the fabric before it is cut into garment pieces.

Knitted fabric webs typically undergo two separate processes to dimensionally stabilize the web, width setting and compacting. While both processes may be performed by the same machinery, which is generally referred to as a compactor, the two processes will be discussed separately.

In general, width setting is accomplished by a fabric compacting system that includes a mechanical spreader for spreading the fabric web to a preset width. A pair of heated rolls then set the fabric web to the width created by the mechanical spreader. If there was little variability in finished fabric, all that would be necessary would be to set the width of the mechanical spreader and run a trial length of fabric web, make a measurement of the width of the compacted fabric, and make a single adjustment of the width of the mechanical spreader. However, the stitch density and/or width of a fabric web may both vary within a batch of fabric.

Variations occur because of the differing machine, knit type, material type, and counts per inch that are specified by fabric and garment designers. Variations also may occur in connection with the finishing process, including, variations caused by mechanical compacting and even processes that occur downstream from the mechanical compacting process. Accordingly, because of such variations, it is necessary to constantly monitor the width and/or stitch density of the fabric web exiting the compactor, and make appropriate upstream adjustments. Unfortunately, however, it is difficult for a human operator to make accurate adjustments to a fabric web exiting a compactor at speeds approaching about 80 yards per minute.

A number of control systems have been developed to monitor and control the width of compacted fabric. These systems have typically included optical measurement devices, such as cameras, that interconnect a controller to the compactor. For example, control systems have been used for direct measurement of a fabric web as it leaves the compactor. It has been found, however, that there is often no consistent relationship between the width of the fabric web entering the mechanical spreader and the width of the fabric web exiting the compactor. As a result, the prior art control systems tended to oscillate out of control as the control system tried to correct errors that were not, or were no longer, the cause of the variation.

One known control system attempted to solve the oscillation problem by using an image camera to capture images of the moving fabric web as it exited the compactor. While the system was able to detect relatively small changes in the width of the fabric web, problems remained in producing compacted fabric of consistent width because of processing that occurred downstream from the compactor.

In addition to producing a fabric web of consistent width, another objective of compacting fabric is shrinkage control. It is known to compress the knitted courses of a fabric web in the lengthwise direction, which imparts predictable shrinkage to the fabric. The fabric web enters the compactor via a feed roller, which is at a selected speed. The fabric then is rolled between the retard roller and a blade, which is rotating at a slightly slower speed than the feed roller. This causes the fabric to compact, so that the web exiting the compactor is dimensionally shorter in the lengthwise direction than the web entering the compactor. In order to control the compaction process, it is necessary to monitor the stitch density, i.e., counts per inch (CPI), of the compacted fabric.

With respect to the monitoring and control of stitch density, conventional techniques have predominantly involved manual counting procedures whereby random samples of the fabric web are examined under magnification lenses. Other known techniques have involved taking optical measurements during fabric formation or during the fabric treatment process. Like known system and methods of width control, however, a reliable system and method to control stitch density has proven to be elusive because of what are now believed to be changes in fabric stability that occur downstream on the exit conveyor of the compacting machine.

Thus, there remains a need for a system and method for ensuring consistent width and stitch density for a fabric web being finished at high speeds that overcomes the disadvantages of the prior art.

SUMMARY OF THE INVENTION

The present invention is directed to a system and method for controlling the width and stitch count of a moving fabric web for a fabric compaction system. In particular, the present invention is directed toward controlling fabric web width for use with fabric compactor systems of the type having a mechanical spreader located upstream of the fabric compactor, and a fabric conveyor downstream of the fabric compactor that delivers compacted fabric to a fabric folder. While it is known that there is a natural tendency for fabric to return to a somewhat relaxed condition after mechanical compaction, it now has been found that the closer the width measurements are taken to the exit of the moving fabric web from the compactor, the less indicative the measurements are of the final web width. It now also has been found that the compacted fabric is pulled, cooled, and shaken with the vibration of conveyance from the compacted fabric conveyor, resulting in a final fabric web having, in some cases, a substantially different width.

One aspect of the present invention is directed to a control system that includes a camera, and a controller. The camera measures the width of the moving fabric web at the downstream end of the compacted fabric conveyor. Specifically, the measurement is taken of the moving fabric web between the discharge end of the conveyor and the fabric folder. In one preferred embodiment, the camera is a CCD camera that is mounted so that it can capture digital images in series at predefined time intervals. The CCD camera is mounted a sufficient distance above the fabric web so that the entire width of the moving fabric web is within the camera's field of view.

The controller interconnects the camera and the mechanical spreader of the fabric compactor for changing the width setting of the mechanical spreader in response to a change in the width of the moving fabric web from a preset value (setpoint). The controller includes a processor for receiving each of the series of digital images captured by the CCD camera. To enable accurate fabric web width measurements, the processor is programmed to determine the light level of the moving fabric web to compensate for the differences between light and dark colored fabric webs. In one embodiment, the system further includes a platen that is mounted proximate the downstream end of the compacted fabric conveyor, the platen having a color that contrasts with the color of the moving fabric web. This enables the processor to accurately locate the left and right edges of the moving fabric web based upon the light contrast between the platen and the moving fabric web.

In the preferred embodiment, the controller is a PID closed loop controller. The controller thus changes the width of the mechanical spreader based on the mathematical relationships between the measured width of the moving fabric web and the preset value. The mathematical relationships between the width of the moving fabric web and the preset value are proportional (P), integral (I), and derivative (D) relationships. The processor is programmed to convert the sum of the proportional, integral, and derivative relationships into a value corresponding to a pulse of power to be provided to the mechanical spreader.

A second aspect of the present invention is directed to a system for controlling the stitch count of a moving fabric web for a fabric compactor system having a feed roller and a retard roller. A fabric conveyor is downstream of the fabric compactor and delivers the compacted fabric to a folder. The system for controlling the stitch count comprises a second camera and a controller.

The camera measures the stitch count of the moving fabric web at the downstream end of the fabric conveyor. In one preferred embodiment, the camera is a CCD camera. The CCD camera is so mounted only inches from the fabric web so that it captures detailed digital images of the stitch pattern of the moving fabric web. The CCD camera is mounted to capture the digital images of the moving fabric between the downstream end of the fabric conveyor and the fabric folder. Digital images are captured by the CCD camera at 1 to 2 second intervals. The system of the present invention also comprises a light source and a light controller. The light source is located behind the moving fabric web for illuminating the moving fabric web, which has been found to contribute substantially to the accuracy of the system of the present invention. In one preferred embodiment, the light source is a strobe that is operably sequenced with the CCD camera light exposure. A tube is connected to the strobe for focusing the light on the portion of the fabric web to be imaged, the tube being selected from the group consisting of fiber optic tubes and liquid light tubes. The light controller automatically adjusts the light intensity behind the moving fabric web for fabric webs of varying colors. The light controller includes a vision processor that is programmed to measure and adjust the light intensity to correspond to the color and style of the moving fabric web. The vision processor is programmed to adjust to the optimum light level by varying the light output of the light source, by moving a light filter in front of the light source, or a combination of both.

The controller interconnects the camera and the retard roller of the fabric compactor for automatically increasing or decreasing the speed setting of the retard roller, and hence, the stitch count of the compacted fabric in response to a change in the stitch count of the moving fabric web from a preset value. In one preferred embodiment, the controller is a PID closed loop controller. The controller changes the rotational speed of the retard roll based on the mathematical relationships between the measured stitch count of the moving fabric web and the preset value. These mathematical relationships between the stitch count of the moving fabric web and the preset value are also proportional, integral, and derivative relationships. The processor is programmed to convert the sum of the proportional, integral, and derivative relationships into an adjusted speed ratio value for the retard roll.

Yet another aspect of the present invention is directed to an integrated fabric web width and stitch control system which combines both aspects of the present invention described hereinabove.

These and other aspects of the present invention will become apparent to those skilled in the art after a reading of the following description of the preferred embodiments when considered in conjunction with the drawings. It should be understood that both the foregoing general description and the following detailed description are exemplary and explanatory only and are not restrictive of the invention as claimed.

DETAILED DESCRIPTION OF THE PREFERRED EMBODIMENTS

Certain exemplary embodiments of the present invention are described below and illustrated in the attached Figures. The embodiments described are only for purposes of illustrating the present invention and should not be interpreted as limiting the scope of the invention, which, of course, is limited only by the claims below. As can be appreciated, the invention can be practiced as a continuous process in a manufacturing environment, in connection with compacting a fabric web, for example. Alternatively, the invention can be reduced to practice as a table top unit for use in determining the width or stitch density of a sample fabric web on a piece basis. The invention may be used in connection with either fabric web width control or stitch density control, or both. Other embodiments of the invention, and certain modifications and improvements of the described embodiments, will occur to those skilled in the art, and all such alternate embodiments, modifications and improvements are within the scope of the present invention.

Figure 1:
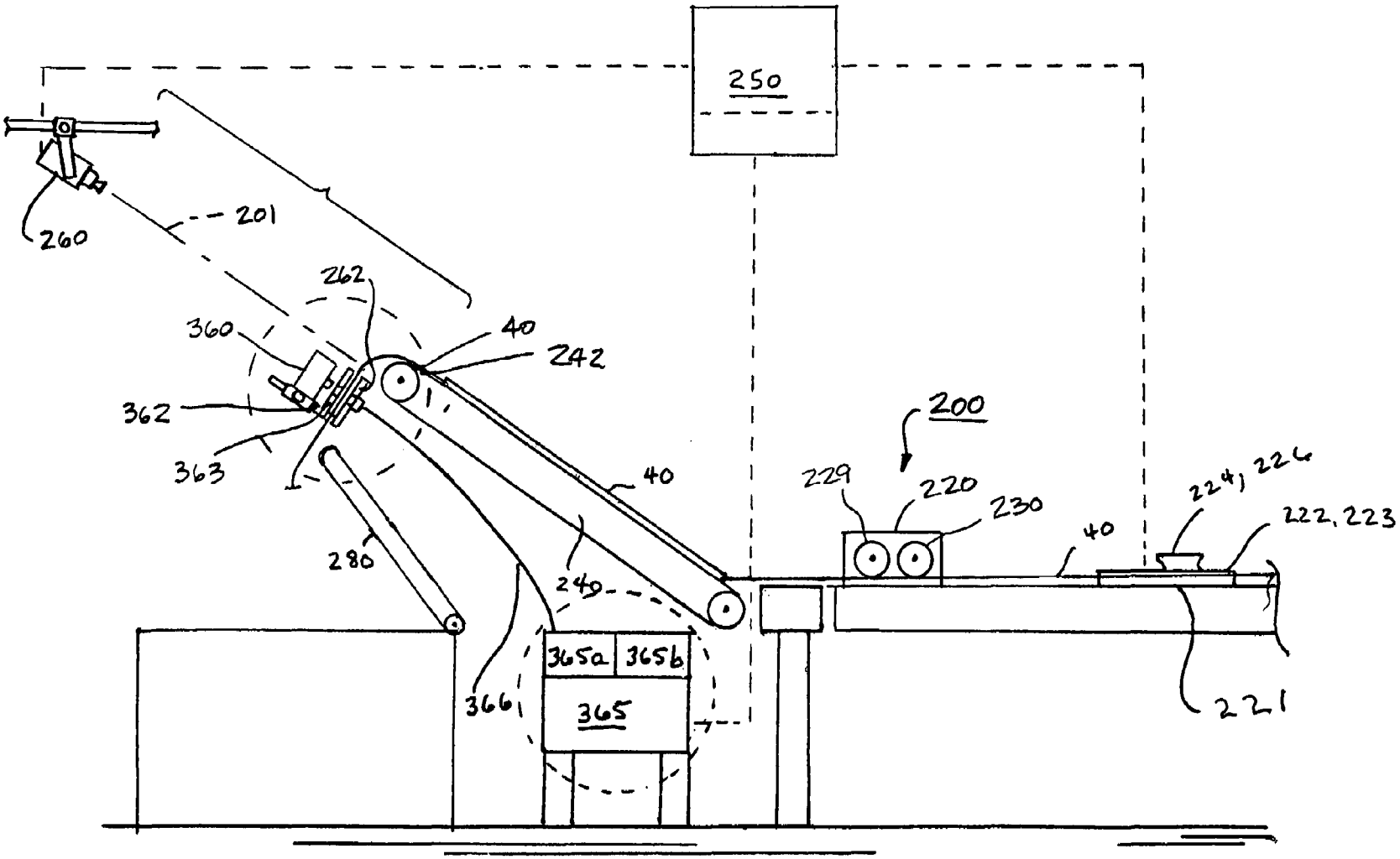
FIG. 1 is a side elevational schematic view of a fabric stitch and width control system constructed according to the present invention.

Referring now to FIG. 1, the fabric compacting system 200 comprises a mechanical spreader 221 having spreader arms 222, 223 located upstream of the compaction chamber 220. A fabric conveyor 240 is located downstream of the compaction chamber 220. The fabric conveyor 240 has a downstream end 242 that delivers compacted fabric to a folder 280.

The mechanical spreader 221 has a pair of rollers 224, 226 to hold the mechanical spreader arms 222, 223 in position at a desired, fabric width set point. Downstream of the mechanical spreader arms 222, 223 is a steam heated retard roller 229, and an unheated intake roller 230. As is well known, mechanical compaction of the fabric web occurs because the unheated intake roller rotates at a first speed and the heated retard roller operates at a second speed, which is less than the speed of the intake roller. Thus, the retard roller causes the knitted fabric web to compact, or compress, along the lengthwise axis of the fabric web 40, and the heat of the roller sets the fabric web in its compacted state. In effect, the fabric web is mechanically preshrunk. Upon exiting the retard roller 229, the heated, compacted fabric web is drawn away by a fabric conveyor 240, where the fabric web may travel several feet before being delivered to the folder 280.

As shown in FIG. 1, the present invention comprises a camera 260 and a controller 250. The camera 260 captures an image of a preselected portion of the moving fabric web proximate to the downstream end 242 of the compacted fabric conveyor 240. The captured image is received by the controller 250, which measures the width of the preselected portion of the moving fabric web based on the captured, received image.

The camera 260 may be a CCD camera that is mounted with universal adjustment brackets (not shown). A CCD camera is a camera that employs a charge-coupled-device (CCD), which is a silicon chip, whose surface has been segmented into an array of individual light-sensitive pixels. When a photon (light particle) hits a pixel, it registers a tiny electric charge that can be counted. With large pixel arrays and high sensitivity, CCDs can create high-resolution images under a variety of light conditions. One suitable CCD camera is available from Sony Electronics Inc. of Park Ridge, N.J. as Model XC-ST-50/ST50CE or XC-ST30/ST30CE. As needed, magnification lenses may be used so that the captured images show sharply defined edges of the moving fabric web. While a CCD camera may be used in connection with the present invention, other cameras can be used without departing from the spirit or scope of the invention.

To ensure that the CCD camera is able to capture an image of the entire width of the moving fabric web, the camera 260 is mounted between about 60 inches and 100 inches above the moving fabric 40, and desirably about 73 inches above the moving fabric web 40. Line 261 depicts the line of sight between the camera and the fabric web. With camera 260 mounted as described herein, no special lighting is required to capture suitable images of the moving fabric web. If, however, fluorescent lighting is used in the vicinity of the moving fabric, solid state lighting ballasts should be used to eliminate the flickering that is common with standard ballasts.

Referring to FIG. 1, a platen 262 is mounted proximate to the downstream end 242, of the fabric conveyor 240 using conventional mounting brackets. The platen is mounted so that fabric web 40 moving over the downstream end 242 of the conveyor 240 will pass over the top side of the platen 262. The platen 262 may be fabricated from a smooth metal and may extend across at least the width of the conveyor 240. The moving fabric web 40 will pass over the platen 262 in a relaxed state.

As can be appreciated, detecting the opposed side edges of the fabric web 40 is extremely important to an accurate measure of the width of the fabric 40. Thus, a light colored (e.g., silver) platen 262 is used when the belt is dark colored and, conversely, a dark (e.g., black) platen 262 is used when the belt is light colored, to create a contrast to other machinery background colors. To ensure accuracy in locating the edges of the fabric web, the camera 260 captures three different images: (1) an image of the fabric against the platen, (2) an image of the fabric against the belt, and (3) an image of the fabric against the belt and the platen at the same instant. This allows the vision processor to select the image of the fabric having the highest contrast against its background (belt or platen), thus ensuring the most accurate width measurement. As those skilled in the art will appreciate, the three images are taken at three different locations relative to the moving fabric web. Thus, in calculating width based on the selected image, a calibration factor is applied.

The controller 250 controls the frequency with which the camera 260 captures images of the preselected portion of the moving fabric web. The captured image is received by the controller as a digital representation that is analyzed by the vision processor. A Cognex MVS 8100 frame grabber board and Cognex Vision Pro software, which has pattern matching capabilities, both of which are available from Cognex of Natick, Mass., may be used to analyze the captured images. This vision processor is "trained" to locate the center of the image, i.e., the center of the fabric web 40, so that any slight movement of the camera due to vibration or bumping will not cause a malfunction of the image capture assembly. By "trained", it is meant that representative ideal images are stored in memory for the vision processor to retrieve and compare with subsequently captured digital images of the moving fabric web.

The processor of the controller is also programmed to measure the light level (FIG. 3, Step 310) of the fabric 40, based upon the light reflected from the fabric. The control software comprises an algorithm that continually adjusts the shutter speed. For example, if the setpoint for the light level is 120, and the measured light level is 100, then the shutter speed of the camera will be decreased automatically (FIG. 3, Step 320) so that the captured image is properly exposed and the opposed side edges of the moving fabric web are discernable. The aperture of the camera, however, is manually set for the ambient light level in the plant environment. Thus, regardless of the lighting conditions, or the color or shade of the fabric, a suitable image of the moving fabric web is captured. As will be appreciated, decreasing the shutter speed or increasing the aperture will increase the amount of light to the film, or other photographic media, whereas increasing the shutter speed or the decreasing the aperture will decrease the amount of light to the film, or other photographic media.

Figure 3:
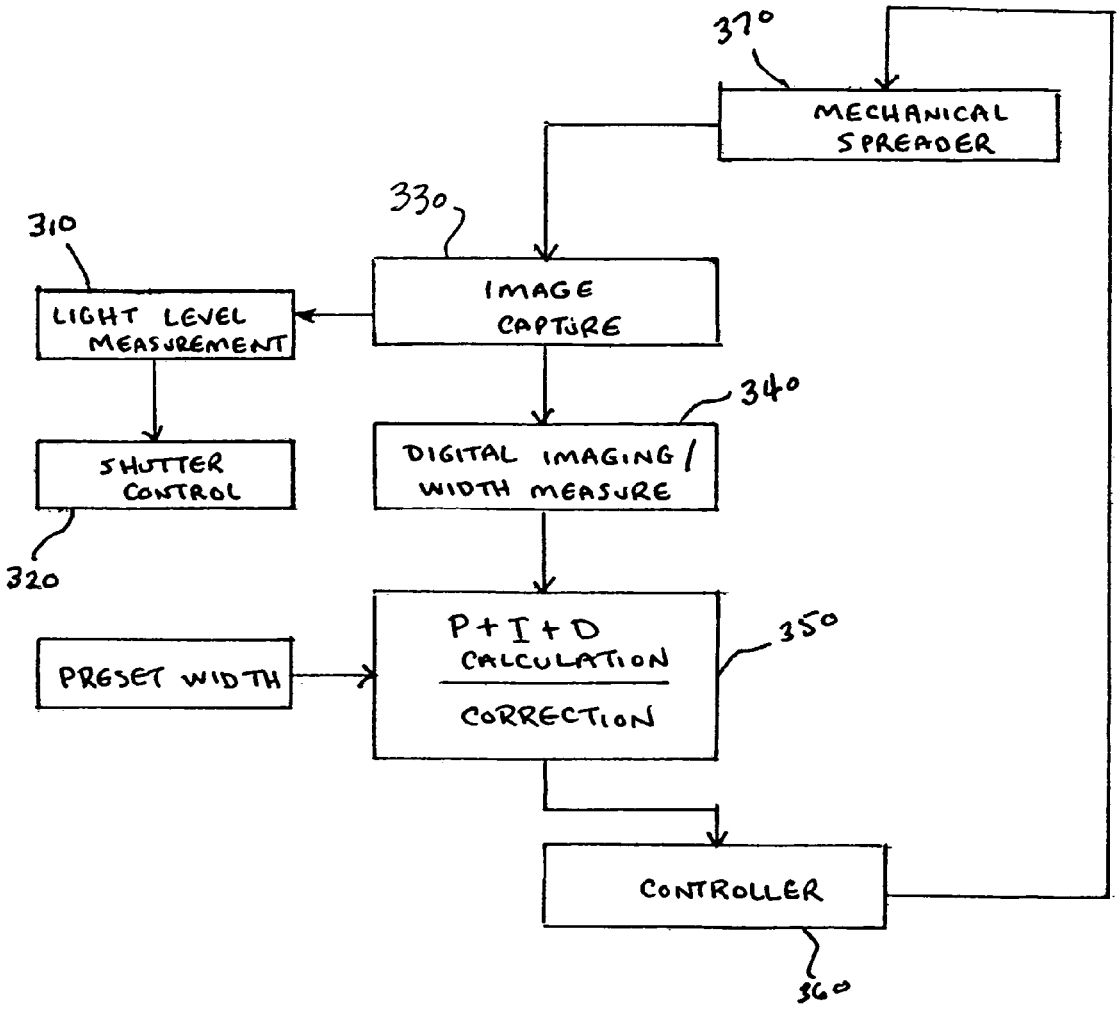
FIG. 3 is a block diagram of the fabric width control system of the present invention.

The vision controller may also include pattern matching software for locating the opposed side edges of the moving fabric web. Once the opposed side edges are located, the camera captures the image (FIG. 3, Step 330) of a preselected portion of the moving fabric web, and the controller then calculates the width of the moving fabric web at the preselected portion using the captured, received image. (FIG. 3, Step 340). The fabric width may be first calculated in pixels, which may be subsequently converted to a linear measurement, such as inches or millimeters.

The controller uses the calculated width of the moving fabric web to adjust the width setting of the mechanical spreader arms 222, 223. As will be explained by way of example below, the controller adjusts the width setting of the fabric web based on the proportional, integral, and derivative relationships of the calculated width versus a fabric width set point (FIG. 3, Step 350). As is known in the art, as the difference between the calculated width and the fabric width set point increases (the difference between the calculated width of the fabric web and the fabric width set point is sometimes referred to as the "error"), the amount of required correction to the width of the mechanical spreader arms increases proportionally to the amount of error. The longer the amount of time that the error persists, a greater correction is required. The speed at which the actual, or measured, value is approaching the desired setpoint determines how the control loop should anticipate by increasing or decreasing the correction magnitude (derivative).

The processor transmits a correction signal to the mechanical spreader arms (FIG. 3, Step 360) 222, 223 at a specified time interval, which, in one embodiment, is about 4 seconds. The mechanical spreader arms 222, 223 either open or close, depending upon the nature of the correction signal (FIG. 3, Step 370). The time interval allows a preselected portion of the fabric web 40 to travel to the downstream end of the conveyor, where an image of the fabric web is captured for purposes of calculating the width of the fabric web, so that the results of the previous correction can be evaluated. The arms of the mechanical spreader may be moved by either a pneumatic motor that uses a solenoid, or an electric motor. When using the pneumatic motor, it has been found that corrections are more satisfactorily made when the air pressure is set below about 35 pounds per square inch. When a variable frequency drive is employed, the speed regulation of the mechanical spreader is slower and smoother. This allows corrections of smaller magnitudes to be made. The controller is thus less likely to overshoot or undershoot the fabric width set point.

The following is an example of the operation of the width control system of the present invention. The assumed conditions are as follows: Fabric width set point is 30.00 inches; initial calculated width is 29.95 inches; the proportional constant is 2.00; the integral constant is 0.20; the derivative constant is 0.50; the PID multiplier is 1000; the deadband is +/−0.05 inches; and, the ramp limit is 1000. These proportional, integral, and derivative constants are representative. As those skilled in the art will appreciate, these constant values are determined based upon actual physical system testing and will vary from one system to another. As used herein, "deadband" is defined as the range within which a correction will not be made by the control system; i.e., the error is very small. Also, as used herein, "ramp limit" is a selected value which prevents over-correction by the system; i.e., a maximum allowable correction. If the processor calculates a correction greater than the ramp limit, then the ramp limit will be substituted for the calculated correction.

Since the initial calculated value (29.95 inches) is within the dead band, no control or correction occurs. Assume the next calculated value, however, is 29.80 inches. The error is now 0.20 inches. Applying the PID calculation as the processor is programmed in accordance with the present invention, and as is conventional for the calculation, the proportional (P) contribution to the calculation output is 0.20×2.00=0.40.

Since the error has only been present for a short time, the 0.20 total error is applied at each time interval; therefore, the integral (I) contribution is 0.20×0.20=0.04. The program compares the new error to the previous error and calculates a difference of 0.15 (29.95−29.80). This difference in error is multiplied by the derivative (D) component, 0.15×0.50=0.075.

The total PID component is P+I+D=0.40+0.04+0.075=0.515; when multiplied by the PID multiplier, 0.515×1000=515. This is compared to the ramp value of 1000; since 515 is less than the ramp value, 515 is used as a pulse magnitude value.

Since the width is too narrow, the spreader arms 222, 223 must be move outward to increase the width of the fabric web 40. Using the value of 515 as a magnitude for generating a pulse to move the spreader assembly, the spreader assembly motor receives power for 515 units of time, in this example, milliseconds. The resulting motion of the spreader arms 222, 223 is a 515 millisecond pulse of power to the spreader arms in the outward direction.

As time progresses, the width between the spreader arms is increased, the width is calculated to be 29.90 inches; thus, the error is 0.10 inches. The error is multiplied by the proportional (P) constant; 0.10×2.00=0.20. An integrated error, which is the sum of the errors at each time interval and which is determined by integration, is now equal to 1.20. The integrated error is multiplied by the integral constant; 1.20×0.2=0.24. The change from the previous measurement is found to be 29.80−29.90=−0.10. This is multiplied by the derivative constant; −0.10×0.50=−0.05.

The total PID component is P+I+D=0.20+0.24−0.05=0.390; when multiplied by the PID multiplier, 0.390×1000=390. This is compared to the ramp value of 1000; since 390 is less than the ramp value, 390 is used as a pulse magnitude value. Again, this is used as a pulse magnitude value, resulting in a 390 millisecond pulse of power to the mechanical spreader motor in the outward direction.

Another embodiment of the present invention is directed to a system for controlling the stitch count, or stitch density, of a moving fabric web for the fabric compactor system described above. As used herein, "stitch count" and "stitch density" may be used interchangeably to refer to the same quantitative measure, which is the number of stitches per inch of a fabric web when measured in the lengthwise direction of the fabric web. As shown in FIG. 2, the system comprises a camera 360 and a controller 250. The camera 360 captures an image of the moving fabric web at the down stream end 242 of the compactor conveyor 240.

The camera 360, like camera 260, in its simplest construction comprises a CCD camera that is mounted with universal adjustment brackets (not shown). One suitable CCD camera is available from Sony Electronics Inc. of Park Ridge, N.J. as Model XC-ST-50/ST50CE or XC-ST30/ST30CE. This is the same model camera that is used with the width control system. To ensure that the CCD camera is able to capture a close-up, detailed image of the stitch pattern of the moving fabric web, the camera 360 is mounted between about 1 inch and 2 inches from the moving fabric 40 web. In particular, the camera is mounted so that it can focus on approximately a ¼ inch×¼ inch area of the fabric web.

Platen 262, which is the same platen that is described above for the width control system, is mounted so that fabric 40 leaving the conveyor 240 will pass over the top of the platen 262. A hole is formed through the approximate center of the platen, as will be explained in more detail below. The CCD camera is mounted directly in front of the platen 262 by means of a bracket 362 having a image capture plate 363 connected thereto. More specifically, the CCD camera is mounted so that the line of sight of the lens passes through the hole in the center of the platen. The image capture plate 363 provides stability for the camera, facilitates removal of the fabric from the conveyor, and stabilizes the fabric. The bracket 362 and image capture plate 363 may be formed as a part of the same mounting structure as the platen 262.

In contrast to the width control subsystem discussed above, supplemental lighting is required for the stitch control subsystem so that a highly detailed image of the stitch pattern of a preselected portion of the moving fabric web may be captured by the camera. The light source is positioned behind the moving fabric web 40 so that the fabric web is between the light source and the camera. The light will then illuminate the stitch structure of the fabric web. This enables the camera to detect the light coming through the interstices between knitted courses. As can be appreciated, the light must be focused on the same preselected portion of the moving fabric web that the CCD camera is focused upon. As will be appreciated by those skilled in the art, the required light intensity for illuminating a dark colored fabric is substantially greater than the light intensity required to illuminate a light colored fabric.

Figure 2A:
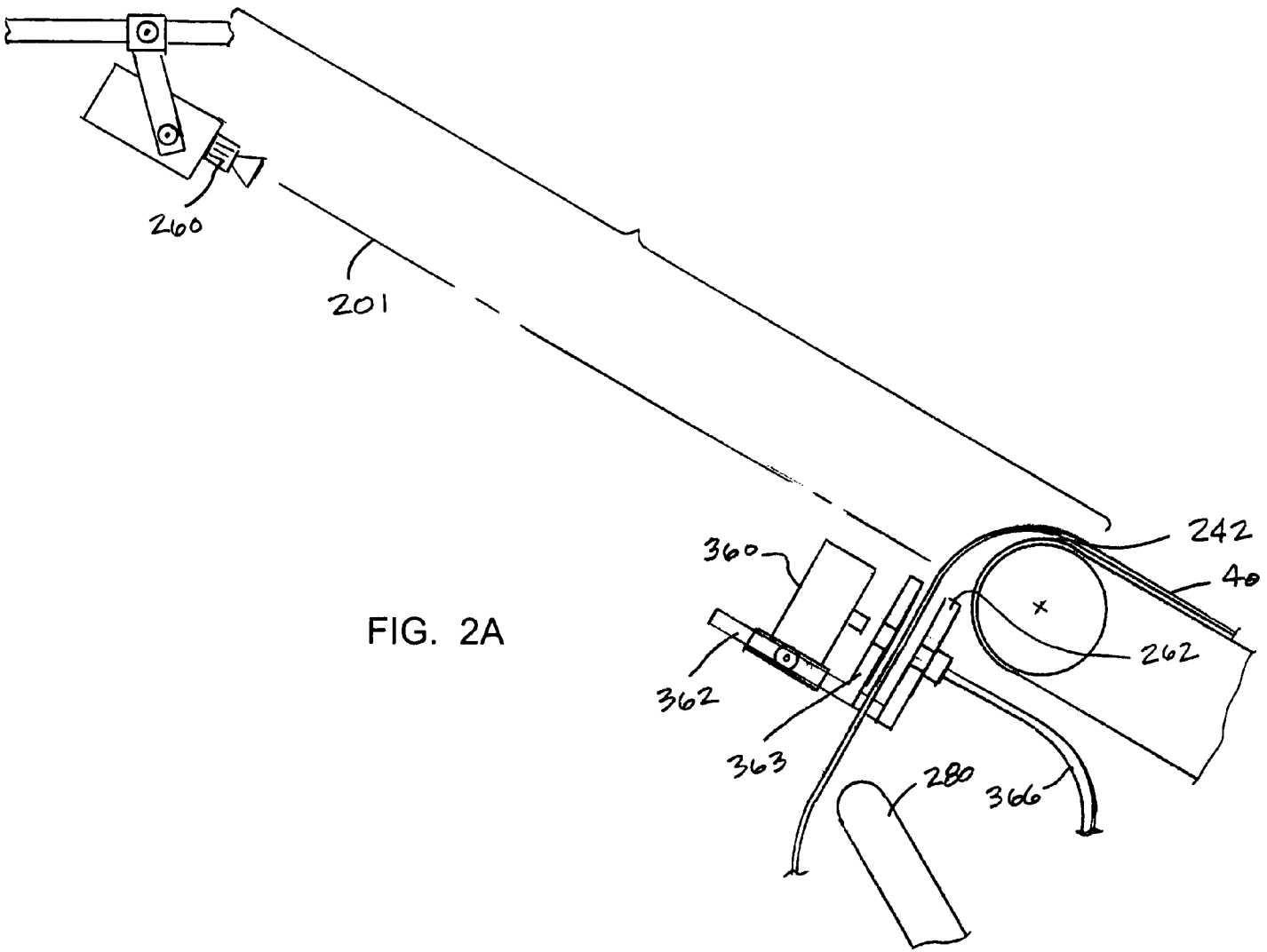
FIG. 2A is a side elevational schematic view of the image capture assembly of the stitch count control system of the present invention.
Figure 2C:
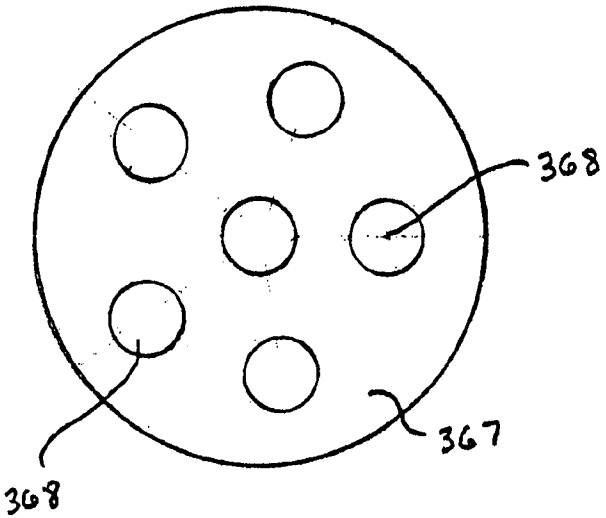
FIG. 2C is a top schematic view of the light adjustment mechanism of the stitch control system of FIG. 2B taken along Line A—A.
Figure 2B:
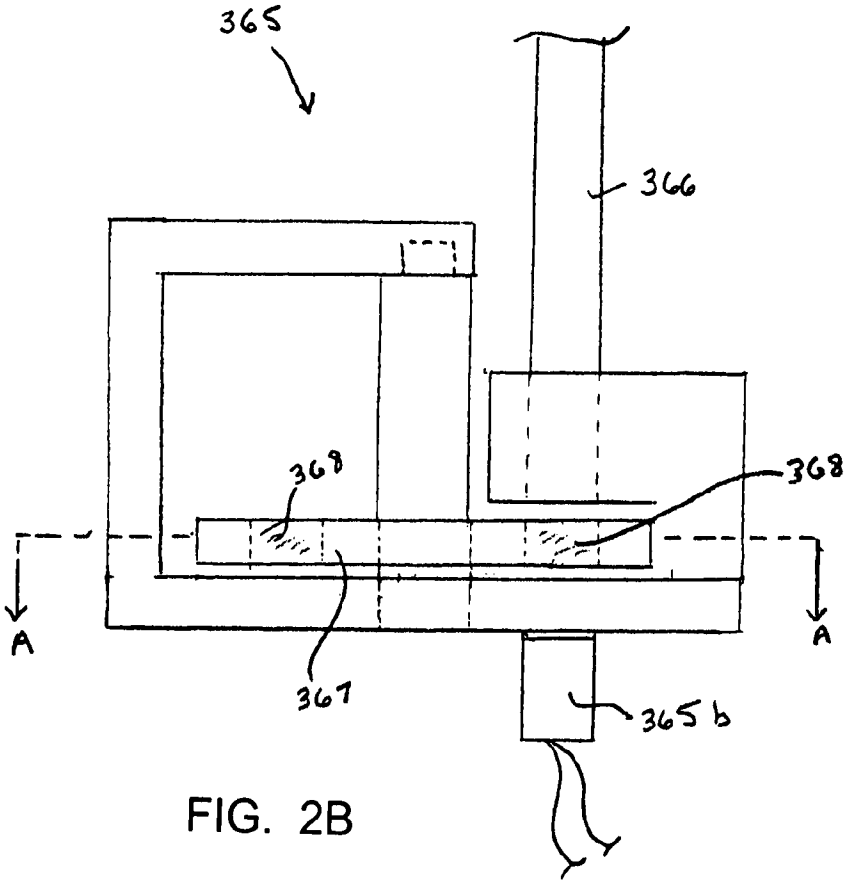
FIG. 2B is a side elevational schematic view of the light source and light adjustment mechanism of the stitch control system of the present invention.

As shown in FIG. 2, a light controller 365 is provided for automatically adjusting the light intensity behind the moving fabric web. The light controller comprises a light source 365*b* and a light adjustment mechanism 365*a*. A strobe light provides a suitable light source 365*b*. One suitable strobe is an MVS-7000 Series Machine Vision Strobe, available from PerkinElmer Optoelectronics of Salem, Mass. Due to space limitations, the light controller 365 may be located remotely from the camera. To direct the light to the preselected portion of the fabric web, a fiber optic tube, or desirably, a liquid light tube 366 may be used. As best seen in FIG. 2A, one end of the light tube 366 is aligned with and fitted to the hole 262*a* in the platen 262. The opposite end of the light tube is aligned with and fitted to the light controller 365.

Because of variability in the thickness and/or color of the fabric web, the light intensity from the light source must be adjustable. The system of the present invention provides a dual approach to adjusting the light intensity. A conventional strobe light, however, does not have sufficient light range intensity to optimally match the full fabric range. The MVS-1010 strobe has a maximum rated output of 210 mJ and the strobe controllable voltage range is approximately 1.5 VDC (minimum light output) to 11.5 VDC (maximum light output). As will be explained in greater detail below, the controller 250 gauges the required light intensity (FIG. 4, Step 410) for the particular fabric. In order to control the light intensity across the required full range, an auxiliary light control method is required. This light intensity adjustment mechanism 365*a* consists of an apparatus containing light blocking filters 368, ranging from heavy blocking capacity to no blocking capacity. In the embodiment shown in FIG. 2A, the mechanism 365*a* comprises a circular wheel 367 that holds 2 to 5 filters 368. The filters are available from Edmund Industrial Optics of Barrington, N.J. as Series ND-REF. The circular wheel 367 is rotably movable so that the selected filter can be optically aligned between the strobe 365*b* and the light tube 366. This permits combinations of strobe power and filters to achieve the broad range needed for the various fabrics.

For example, when the strobe is outside of the optimum range for the fabric being processed, the processor will first attempt to change the power of the strobe 365*b* to maintain the desired light intensity. When the strobe 365*b* is at its maximum or minimum power level and the light level is not achieved, the processor will then select the appropriate light blocking filter 368 to achieve the desired intensity (FIG. 4, Step 420).

Figure 4:
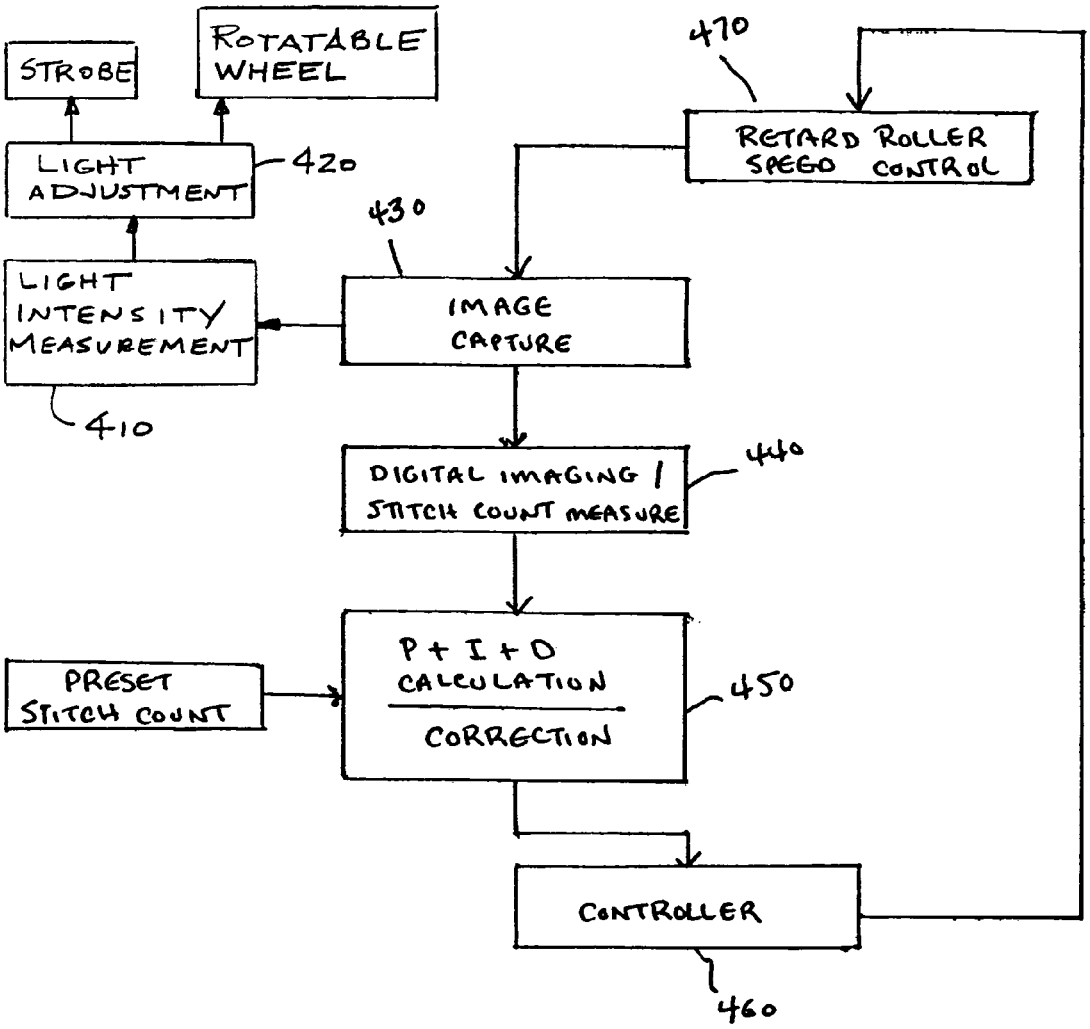
FIG. 4 is a block diagram of the fabric stitch density control system of the present invention.

The controller 250 of the stitch count control system initially controls the frequency at which the strobe light is triggered so that the CCD camera captures the image of the fabric under the optimum conditions (FIG. 4, Step 430). This embodiment of the invention utilizes the same frame grabber board and vision processing software as the width control system. When triggered, the strobe 365*b* transmits a burst of light through the light tube 366. The processor 252 then acquires the image of the fabric captured by the CCD camera. Even though the fabric is two-ply (tubular knit), the image appears to be of a single-ply fabric. This is because the camera lens is focused on the top-ply; therefore, detail and stitch count will be made only of the top ply. Because the strobe 365*b* is providing background illumination when the image is captured, the holes between knitted courses appear as small circles of light. Thus, the light passing through the fabric creates a contrast with the material stitches. The processor 252 uses the distance between the vertical light circles to convert to stitch count. To ensure that the processor does not erroneously select light circles from horizontally adjacent knitted courses, stitches will be discarded from the conversion if the stitch is greater than 15 degrees from vertical.

The processor 252 is also programmed with a "trained" image of a suitable stitch. Further, the processor has the versatility to recognize different types of fabric constructions, as the trained image of a stitch may vary from one knit pattern to another. During the processing of each image, the program searches the image for matches to the ideal trained stitch pattern. The processor 252 is programmed to randomly locate matches up to a desired number, currently set at 12. The program then averages the matches to determine an average stitch count (FIG. 4, Step 440). As those skilled in the art will appreciate, there are multiple ways to statistically obtain an average stitch count.

The results of the image analysis and averaging are input to the stitch control algorithm, as explained in greater detail in the example below. The stitch control algorithm, similar to the width control algorithm, makes corrections to the fabric stitch count based on the proportional, integral, and derivative relationships of the measured stitch count versus the setpoint (FIG. 4, Step 450). A correction is then transmitted (FIG. 4, Step 460) to the retard roller 229 to change the speed relationship (FIG. 4, Step 470) between the feed roller 230 and the retard roller 229.

The operation of the stitch count control system of the present invention is as follows. The following are assumed conditions for the stitch density control subsystem of the present invention: Stitch density set point is 44.00 stitches (or "counts") per inch; initial measured value is 44.10 counts per inch; the proportional constant is 2.00; the integral constant is 0.20; the derivative constant is 0.50; the PID divisor is 100. A divisor is used here because the range needed for speed control requires a small incremental change than for width. The retard roller is operating at a setting of 0.80; the deadband is +/−0.25 counts per inch; and, the ramp limit is 0.25. These proportional, integral, and derivative constants are representative.

Since the initial measured value (44.10 counts per inch) is within the dead band, no control or correction occurs. Assume the next measured value, however, is 44.50 counts per inch. The error is now 0.50 counts per inch. Applying the PID calculation as the processor is programmed in accordance with the present invention, and as is conventional for the calculation, the proportional (P) contribution to the calculation output is 0.50×2.00=1.00.

Since the error has only been present for a short time, the 1.00 total error is applied at each time interval; therefore, the integral (I) contribution is 0.50×0.20=0.10. The program compares the new error to the previous error and calculates a difference of 0.40(44.50− 44.10). This difference in error is multiplied by the derivative (D) component, 0.40×0.50= 0.20.

The total PID component is P+I+D=1.00+0.10+0.20= 1.30; when divided by the PID divisor, 1.30/100=0.0130. This is compared to the ramp value of 0.25; since 0.0130 is less than the ramp value, 0.0130 is used correct the speed of the retard rollers.

Since the stitch count is too high, it can be increased by increasing the speed of the retard rollers 229*a*, 229*b*. Therefore, the results of the PID calculation are added to the existing speed ratio of 0.80, and the new ratio becomes 0.8130:1.0000.

As time progresses, the stitch count is measured at 44.35; thus, the error is 0.35. The error is multiplied by the proportional (P) constant; 0.35×2.00=0.70. The integrated error is now equal to 2.50 (this program performs the integration to obtain this value which is the sum of the errors at each time interval). The integrated error is multiplied by the integral constant; 2.50×0.2=0.50. The change from the previous measurement is found to be 44.35−44.50=−0.15. This is multiplied by the derivative constant; −0.15×0.50= −0.075.

The total PID component is P+I+D=0.70+0.50−0.075= 1.1250; when divided by the PID divisor, 1.1250/100= 0.01125. This is compared to the ramp value of 0.25; since 0.01125 is less than the ramp value, 0.01125 is used to correct the speed of the retard roller.

Although the present invention has been described with exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

We claim:

1. A system for controlling the width of a moving fabric web that is moving through a fabric compactor system, the fabric compactor system having a mechanical spreader, a compactor, a fabric conveyor and a folder, wherein the mechanical spreader is located upstream of the compactor, the compactor is located upstream of the fabric conveyor, and the fabric conveyor has a downstream end that delivers a moving fabric web to a folder, comprising:

(a) a camera, wherein the camera captures an image of a preselected portion of a moving fabric web at a preselected position on the fabric conveyor;

(b) a controller, wherein the controller receives from the camera the captured image of the preselected portion of the moving fabric web;

calculates the width of the preselected portion of the moving fabric web using the received, captured image;

compares the calculated width of the moving fabric web to a first width set point; and causes a width setting of the mechanical spreader to change from the first width set point to a second width set point if the calculated width of the preselected portion of the moving fabric web varies from the first width set point.

2. The system of claim 1, wherein the camera is a CCD camera.

3. The system of claim 1 wherein the camera is mounted to capture a series of digital images of the fabric web.

4. The system of claim 1 wherein the camera captures an image of the entire width of the moving fabric web.

5. The system of claim 2 wherein the CCD camera is mounted between about 60 inches and 100 inches above the moving fabric web.

6. The system of claim 1 wherein, the controller determines the amount of light reflected from the moving fabric web using the received, captured image of the preselected portion of the moving fabric web.

7. The system of claim 6 further including a platen mounted proximate to the downstream end of the fabric conveyor, the platen having a color that contrasts with the color of the moving fabric web.

8. The system of claim 7, wherein the controller locates left and right edges of the moving fabric web using the captured, received image of the preselected portion of the moving fabric web based upon light contrast between the platen and the moving fabric web.

9. The system of claim 1 wherein the controller is a PID closed loop controller.

10. The system of claim 9 wherein the controller causes the width setting of the mechanical spreader to change from the first width set point to the second width set point based upon proportional, integral, and derivative relationships between the first width set point and the second width set point.

11. The system of claim 10 wherein the controller converts the sum of the proportional, integral, and derivative relationships into a pulse of power to the mechanical spreader.

12. A system for controlling the stitch count of a moving fabric web compacted by a fabric compactor system, the fabric compactor system having a compaction chamber, wherein the compaction chamber has an intake roller and a retard roller, a fabric conveyor, and a folder, wherein the fabric conveyor is downstream of the compaction chamber, the fabric conveyor has a downstream end that delivers a compacted fabric web to a folder, comprising:

(a) a camera that captures an image of a preselected portion of the moving fabric web at a preselected position of the fabric conveyor;

(b) a controller, wherein the controller receives from the camera the captured image of the preselected portion of the moving fabric web;

calculates the stitch count of the preselected portion of the moving fabric web using the received, captured image;

compares the calculated stitch count to a first stitch count set point; and causes a compaction setting of the compaction chamber to change from the first stitch density set point to a second stitch density set point if the calculated stitch density of the preselected portion of the moving fabric web varies from the first stitch density set point.

13. The system of claim 12 wherein the camera is a CCD camera, the CCD camera being positioned to capture an image of a preselected portion of a first side of the moving fabric web.

14. The system of claim 13 further including:

(a) a light source positioned so that it illuminates the second side of the moving fabric web; and (b) a light controller for automatically adjusting the intensity of the light source based on a backlit image of the fabric web.

15. The system of claim 14 wherein the light controller:
receives backlit images of the fabric, calculates the light level;
compares the light level of the images to an established setpoint; and
automatically adjusts the intensity of the light.

16. The system of claim 13 wherein the CCD camera is mounted between about 1 inch and 2 inches from the moving fabric web.

17. The system of claim 14 wherein the light source is a strobe light.

18. The system of claim 17 further including a tube connected to the strobe for focusing the light on the preselected portion of the moving fabric web.

19. The system of claim 18 wherein the tube is a fiber optic tube or a liquid light tube.

20. The system of claim 14 wherein the light controller comprises:
(a) a vision processor that measures the light intensity, and adjusts the light intensity in response to measured light intensity; and
(b) a movable holder having a plurality of light filters mounted therein.

21. The system of claim 20 wherein the vision processor adjusts the light intensity by varying the light output of the light source.

22. The system of claim 20 wherein the vision processor adjusts the light intensity by moving a selected one of the plurality of light filters to a position between the light source and the preselected portion of the moving fabric web.

23. The system of claim 20 wherein the vision processor adjusts the light intensity by varying the light output of the light source and by moving a selected one of the plurality of light filters to a position between the light source and the preselected portion of the moving fabric web.

24. The system of claim 12 wherein the controller is a PID closed loop controller.

25. The system of claim 12 wherein the controller changes the rotational speed of the retard roller based on the difference between the calculated stitch count of the preselected portion of the moving fabric web and the first stitch density set point.

26. The system of claim 25 wherein the controller causes the rotational speed of the retard roller to change upon proportional, integral, and derivative relationships calculated stitch count of the preselected portion of the moving fabric web and the first stitch density set point.

27. The system of claim 26 wherein the controller converts the sum of the proportional, integral, and derivative relationships into an adjusted speed ratio for the retard roller.

28. A system for controlling the width and stitch density of a moving fabric web compacted by a fabric compactor system, the fabric compactor system having a mechanical spreader, a compaction chamber downstream from the mechanical spreader, wherein the compaction chamber has an intake roller and a retard roller, a fabric conveyor downstream of the compaction chamber, wherein the fabric conveyor has a downstream end that delivers a compacted fabric web to a folder, wherein the folder is downstream of the fabric conveyor, comprising:
(a) a width control subsystem comprising:
(i) a first camera, wherein the first camera captures an image of a preselected portion of a moving fabric web at a preselected position on the fabric conveyor;
(ii) a first controller, wherein the first controller receives from the first camera the captured image of the preselected portion of the moving fabric web;
calculates the width of the preselected portion of the moving fabric web using the received, captured image;
compares the calculated width of the moving fabric web to a first width set point; and
causes a width setting of the mechanical spreader to change from the first width set point to a second width set point if the calculated width of the preselected portion of the moving fabric web varies from the first width set point;
(b) a stitch count control subsystem comprising:
(i) a second camera that captures an image of a preselected portion of the moving fabric web;
(ii) a second controller, wherein the second controller receives from the second camera the captured image of the preselected portion of the moving fabric web;
calculates the stitch count of the preselected portion of the moving fabric web using the received, captured image;
compares the calculated stitch count to a first stitch count set point; and
causes a compaction setting of the compaction chamber to change from the first stitch density set point to a second stitch density set point if the calculated stitch density of the preselected portion of the moving fabric web varies from the first stitch density set point.

29. The system of claim 28, wherein the first and second cameras are CCD cameras.

30. The system of claim 28 wherein the first camera captures an image of the entire width of the moving fabric web.

31. The system of claim 30 wherein the first CCD camera is mounted between about 60 inches and 100 inches above the moving fabric web.

32. The system of claim 28 wherein, the first controller determines the amount of light reflected from the moving fabric web using the received, captured image of the preselected portion of the moving fabric web.

33. The system of claim 32 further including a platen mounted proximate to the downstream end of the fabric conveyor, the platen having a color that contrasts with the color of the moving fabric web.

34. The system of claim 33, wherein the first controller locates left and right edges of the moving fabric web using the captured, received image of the preselected portion of the moving fabric web based upon light contrast between the platen and the moving fabric web.

35. The system of claim 28 wherein the first controller is a PID closed loop controller.

36. The system of claim 35 wherein the first controller causes the width setting of the mechanical spreader to change from the first width set point to the second width set point based upon proportional, integral, and derivative relationships between the first width set point and the second width set point.

37. The system of claim 36 wherein the first controller converts the sum of the proportional, integral, and derivative relationships into a pulse of power to the mechanical spreader.

38. The system of claim 29 wherein the second CCD camera is positioned to capture an image of a preselected portion of a first side of the moving fabric web.

39. The system of claim 37 further including:
(a) a light source positioned so that it illuminates the second side of the moving fabric web; and (b) a light controller for automatically adjusting the light intensity of the light source based on a backlit image of the fabric web.

40. The system of claim 39 wherein the light controller:

receives backlit images of the fabric, calculates the light level;

compares the light level of the images to an established setpoint; and automatically adjusts the intensity of the light.

41. The system of claim 29 wherein the second CCD camera is mounted between about 1 inch and 2 inches from the moving fabric web.

42. The system of claim 39 wherein the light source is a strobe light.

43. The system of claim 42 further including a tube connected to the strobe for focusing the light on the preselected portion of the moving fabric web.

44. The system of claim 43 wherein the tube is a fiber optic tube or a liquid light tube.

45. The system of claim 39 wherein the light controller comprises:

(a) a vision processor that measures the light intensity, and adjusts the light intensity in response to; and (b) a movable holder having a plurality of light filters mounted therein.

46. The system of claim 45 wherein the vision processor adjusts the light intensity by varying the light output of the light source.

47. The system of claim 45 wherein the vision processor adjusts the light intensity by moving a selected one of the plurality of light filters to a position between the light source and the preselected portion of the moving fabric web.

48. The system of claim 45 wherein the vision processor adjusts the light intensity by varying the light output of the light source and by moving a selected one of the plurality of light filters to a position between the light source and the preselected portion of the moving fabric web.

49. The system of claim 28 wherein the second controller is a PID closed loop controller.

50. The system of claim 28 wherein the second controller changes the rotational speed of the retard roller based on the difference between the calculated stitch count of the preselected portion of the moving fabric web and the first stitch density set point.

51. The system of claim 50 wherein the controller causes the rotational speed of the retard roller to change upon proportional, integral, and derivative relationships calculated stitch count of the preselected portion of the moving fabric web and the first stitch density set point.

52. The system of claim 51 wherein the controller converts the sum of the proportional, integral, and derivative relationships into an adjusted speed ratio for the retard roller.

53. A method for controlling the width of a moving fabric web that is moving through a fabric compactor system, the fabric compactor system having a mechanical spreader, a compactor, a fabric conveyor and a folder, wherein the mechanical spreader is located upstream of the compactor, the compactor is located upstream of the fabric conveyor, and the fabric conveyor has a downstream end that delivers a moving fabric web to a folder, comprising:

(a) using a camera, capturing an image of a preselected portion of a moving fabric web at a preselected position on the fabric conveyor;

(b) sending the captured image of the preselected portion of the moving fabric web to a controller, wherein the controller;

calculates the width of the preselected portion of the moving fabric web using the received, captured image;

compares the calculated width of the moving fabric web to a first width set point; and causes a width setting of the mechanical spreader to change from the first width set point to a second width set point if the calculated width of the preselected portion of the moving fabric web varies from the first width set point.

54. The method of claim 53, wherein the camera is a CCD camera.

55. The method of claim 53 wherein the camera is mounted to capture a series of digital images of the fabric web.

56. The method of claim 53 wherein the camera captures an image of the entire width of the moving fabric web.

57. The method of claim 54 wherein the CCD camera is mounted between about 60 inches and 100 inches above the moving fabric web.

58. The method of claim 51 wherein, the controller:

determines the amount of light reflected from the moving fabric web using the received, captured image of the preselected portion of the moving fabric web; and creates a contrast sufficient to analyze the image based on the amount of reflected light.

59. The method of claim 58 further including a platen mounted proximate to the downstream end of the fabric conveyor, the platen having a color that contrasts with the color of the moving fabric web.

60. The method of claim 59, wherein the controller locates left and right edges of the moving fabric web using the captured, received image of the preselected portion of the moving fabric web based upon light contrast between the platen and the moving fabric web.

61. The method of claim 53 wherein the controller is a PID closed loop controller.

62. The method of claim 61 wherein the controller causes the width setting of the mechanical spreader to change from the first width set point to the second width set point based upon proportional, integral, and derivative relationships between the first width set point and the second width set point.

63. The system of claim 62 wherein the controller converts the sum of the proportional, integral, and derivative relationships into a pulse of power to the mechanical spreader.

64. A method for controlling the stitch count of a moving fabric web compacted by a fabric compactor system, the fabric compactor system having a compaction chamber, wherein the compaction chamber has an intake roller and a retard roller, a fabric conveyor, and a folder, wherein the fabric conveyor is downstream of the compaction chamber, the fabric conveyor has a downstream end that delivers a compacted fabric web to a folder, comprising:

(a) using a camera, capturing an image of a preselected portion of the moving fabric web at a preselected position on the fabric conveyor;

(b) sending the captured image to a controller, wherein the controller;

receives from the camera the captured image of the preselected portion of the moving fabric web;

calculates the stitch count of the preselected portion of the moving fabric web using the received, captured image;

compares the calculated stitch count to a first stitch count set point; and causes a compaction setting of the compaction chamber to change from the first stitch density set point to a second stitch density set point if the calculated stitch density of the preselected portion of the moving fabric web varies from the first stitch density set point.

65. The method of claim 64 wherein the camera is a CCD camera, the CCD camera being positioned to capture an image of a preselected portion of a first side of the moving fabric web.

66. The method of claim 65 further including:

(a) a light source positioned so that it illuminates the second side of the moving fabric web; and (b) a light controller for automatically adjusting the light intensity of the light source based on a backlit image of the fabric web.

67. The system of claim 66 wherein the light controller:

receives backlit images of the fabric, calculates the light level;

compares the light level of the images to an established setpoint; and automatically adjusts the intensity of the light.

68. The method of claim 65 wherein the CCD camera is mounted between about 1 inch and 2 inches from the moving fabric web.

69. The method of claim 66 wherein the light source is a strobe light.

70. The method of claim 69 further including a tube connected to the strobe for focusing the light on the preselected portion of the moving fabric web.

71. The method of claim 70 wherein the tube is a fiber optic tube or a liquid light tube.

72. The method of claim 66 wherein the light controller comprises:

(a) a vision processor that measures the light intensity, and adjusts the light intensity in response to changes in color, weight, or thickness of the fabric web; and (b) a movable holder having a plurality of light filters mounted therein.

73. The method of claim 72 wherein the vision processor adjusts the light intensity by varying the light output of the light source.

74. The method of claim 72 wherein the vision processor adjusts the light intensity by moving a selected one of the plurality of light filters to a position between the light source and the preselected portion of the moving fabric web.

75. The method of claim 72 wherein the vision processor adjusts the light intensity by varying the light output of the light source and by moving a selected one of the plurality of light filters to a position between the light source and the preselected portion of the moving fabric web.

76. The method of claim 64 wherein the controller is a PID closed loop controller.

77. The method of claim 64 wherein the controller changes the rotational speed of the retard roller based on the difference between the calculated stitch count of the preselected portion of the moving fabric web and the first stitch density set point.

78. The method of claim 64 wherein the controller causes the rotational speed of the retard roller to change upon proportional, integral, and derivative relationships of the calculated stitch count of the preselected portion of the moving fabric web and the first stitch density set point.

79. The method of claim 78 wherein the controller converts the sum of the proportional, integral, and derivative relationships into an adjusted speed ratio for the retard roller.

* * * * *